US006082115A

United States Patent [19]

Strnad

[11] Patent Number: 6,082,115

[45] Date of Patent: Jul. 4, 2000

[54] TEMPERATURE REGULATOR CIRCUIT AND PRECISION VOLTAGE REFERENCE FOR INTEGRATED CIRCUIT

[75] Inventor: Richard J. Strnad, Cupertino, Calif.

[73] Assignee: National Semiconductor Corporation, Santa Clara, Calif.

[21] Appl. No.: 09/216,032

[22] Filed: Dec. 18, 1998

[51] Int. Cl.[7] ..... F25B 21/02; H05K 7/20

[52] U.S. Cl. ..... 62/3.7; 62/259.2; 323/907; 361/688

[58] Field of Search ..... 62/3.7, 259.2; 323/907; 361/676, 688

[56] References Cited

U.S. PATENT DOCUMENTS

| | | | |
|---|---|---|---|
| 3,766,444 | 10/1973 | Bosch | 317/234 R |
| 4,058,779 | 11/1977 | Fraley | 331/108 R |
| 4,757,528 | 7/1988 | Falater et al. | 379/412 |
| 4,812,733 | 3/1989 | Tobey | 323/285 |
| 5,079,618 | 1/1992 | Farnworth | 357/81 |
| 5,166,777 | 11/1992 | Kataoka | 257/716 |
| 5,229,327 | 7/1993 | Farnworth | 437/209 |
| 5,267,252 | 11/1993 | Amano | 372/34 |
| 5,419,780 | 5/1995 | Suski | 136/205 |
| 5,430,322 | 7/1995 | Koyanagi | 257/467 |
| 5,457,342 | 10/1995 | Herbst | 257/712 |
| 5,515,682 | 5/1996 | Nagakubo et al. | 62/3.7 |
| 5,689,958 | 11/1997 | Gaddis et al. | 62/3.7 |
| 5,697,082 | 12/1997 | Greer et al. | 455/255 |
| 5,706,302 | 1/1998 | Shimizu | 372/36 |
| 5,714,791 | 2/1998 | Chi et al. | 257/467 |
| 5,724,818 | 3/1998 | Iwata et al. | 62/3.7 |

OTHER PUBLICATIONS

Shanks, et al., Thermal Conductivity of Silicon from 300 to 1400°K*, Physical Review, vol. 130, No. 5, Jun. 1, 1963, pp. 1743–1748.

Louw, et al., Inductor–Less, Capacitor–Less State–Variable Electrothermal Filters, IEEE Journal of Solid–State Circu, May 1975, pp. 416–424.

Heasell, E.L., The Heat–Flow Problem in Silicon: An Approach to an Analytical Solution with Application to the Calculation of Thermal Instability in Bipolar Devices, IEEE Transaction on Electron Devices, vol. ED–25, No. 12, Dec. 1978, pp. 1382–1388.

*Primary Examiner*—William Doerrler
*Attorney, Agent, or Firm*—Limbach & Limbach L.L.P.

[57] ABSTRACT

A temperature-insensitive reference voltage for an integrated circuit is created by positioning a reference voltage generator circuit proximate to a temperature control structure formed directly on the chip. The temperature control structure utilizes the Peltier Effect to translate an applied voltage into a change in temperature. The voltage applied to the temperature control structure is regulated by a temperature regulator circuit. Both the temperature regulator circuit and the reference voltage generator circuit are formed from standard IC components. In response to detected changes in ambient temperature, the temperature regulator circuit communicates a control voltage to the temperature control structure. The thermal environment, and hence voltage output, of the voltage reference generator circuit is thus stabilized by Peltier heating and cooling relative to changes in ambient temperature.

20 Claims, 5 Drawing Sheets

TEMPERATURE REGULATOR CIRCUIT AND PRECISION VOLTAGE REFERENCE FOR INTEGRATED CIRCUIT

BACKGROUND OF THE INVENTION

1. Field of the Invention

The present invention relates to a voltage reference circuit, and in particular to a temperature-insensitive voltage reference for an integrated circuit.

2. Description of the Related Art

The role played by voltage references in data acquisition systems and measuring instruments is critical. In hundreds of such applications, the magnitude of an unknown voltage is determined by measuring its size relative to a voltage reference.

A voltage reference therefore must produce an accurate and stable output regardless of mechanical shocks or other adverse environmental conditions.

In designing any type of voltage reference circuit, important factors such as device size, spacing, and possible mechanical stress must be considered. However, by far the most important design consideration is the thermal environment in which the voltage reference circuit is to be located.

In fact, while voltage reference circuits are intentionally configured to exhibit insensitivity to changes in ambient temperature, actual circuit design typically consumes only about 5% of the total creative effort, with management of thermal energy and supporting characterization on the chip consuming the remaining 95% of the effort. The difficulty in managing the thermal environment of the voltage reference is better appreciated when it is recognized that all of the surrounding semiconducting devices on the IC contribute a varying amount of thermal energy during operation.

Therefore, there is a need in the art for a precision voltage reference circuit which is insensitive to changes in ambient temperature.

SUMMARY OF THE INVENTION

The present invention relates to a temperature-insensitive voltage reference circuit utilizing the Peltier Effect to control the thermal environment of the reference voltage generator circuit. A Peltier temperature control structure is positioned directly on an IC proximate to the reference voltage generator circuit. Application of a voltage to the Peltier temperature control structure stabilizes the local temperature of the reference voltage generator circuit. This constant local temperature ensures generation of a reference voltage that is substantially constant over a range of ambient temperatures.

A voltage reference circuit in accordance with the present invention comprises a temperature regulator circuit for maintaining a region of the integrated circuit at a substantially constant temperature, the temperature regulator circuit including a temperature sensor circuit formed on the integrated circuit and generating a control voltage in response to a change in ambient temperature, a driver circuit formed on the integrated circuit and receiving the control voltage and generating a driver voltage, and a temperature control structure formed proximate to the integrated circuit region and receiving the driver voltage and in response causing either Peltier heating or cooling of the integrated circuit region. The voltage reference circuit also comprises a reference voltage generator circuit positioned in the integrated circuit region and generating a reference voltage which remains substantially constant with changes in ambient temperature.

The features and advantages of the present invention will be better understood upon consideration of the following detailed description of the invention and the accompanying drawings.

DETAILED DESCRIPTION

Creation and operation of temperature control structures utilizing the Peltier Effect are discussed at length in co-pending, commonly assigned U.S. patent application Ser. No. 09/216,282, entitled "TEMPERATURE CONTROL STRUCTURE FOR INTEGRATED CIRCUIT" (atty. docket no. NSC1-E8800), hereby incorporated by reference.

The present invention relates to a precision voltage reference circuit utilizing the Peltier Effect to control the thermal environment of a reference voltage generator circuit, thereby ensuring generation of a temperature-insensitive reference voltage that is stable over a range of ambient temperatures.

According to the Peltier Effect, current passed through junctions of dissimilar conductors will result in absorption of heat at one junction, and emission of heat at the other junction.

Figure 1:
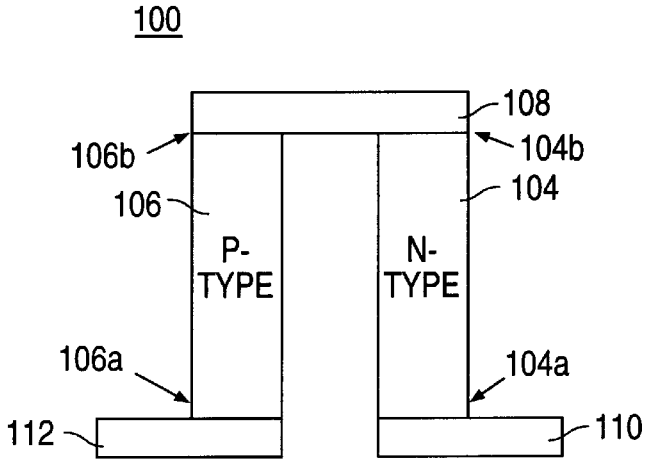
FIG. 1 shows a simple Peltier temperature control structure.

FIG. 1 shows a simple Peltier temperature control structure that can be utilized under the present invention to control the temperature of a specific IC region. Peltier cell structure 100 includes doped N- and P-type conductivity regions 104 and 106, respectively. Second end 104*b* of N-type region 104 and second end 106*b* of P-type region 106 are electrically connected by metal bridge 108. First end 104*a* of N-type block 104 and first end 106*a* of N-type block 106 are connected to metal contacts 110 and 112, respectively.

Application of a potential difference across contacts 110 and 112 results in a temperature change at metal/silicon junctions. Specifically, application of a negative voltage difference across N-type region contact 110 and P-type region contact 112 results in a temperature increase at contacts 110 and 112, and a corresponding temperature decrease at metal bridge 108. Conversely, application of a positive voltage difference across N-type contact 110 and P-type contact 112 would result in a fall in the temperature of contacts 110 and 112 and a corresponding rise in the temperature of metal strip 108.

Standard processing techniques may readily be employed to fabricate Peltier cell 100 on a semiconducting chip. For example, alternating N- and P-type regions 104 and 106 can be created in underlying silicon by ion implantation, or by deposition followed by thermal drive-in. Conducting bridges 108 joining N- and P-type regions 104 and 106 could be fabricated from metal during the same step as formation of metal lines connecting semiconducting devices present on other areas of the chip.

Figure 2:
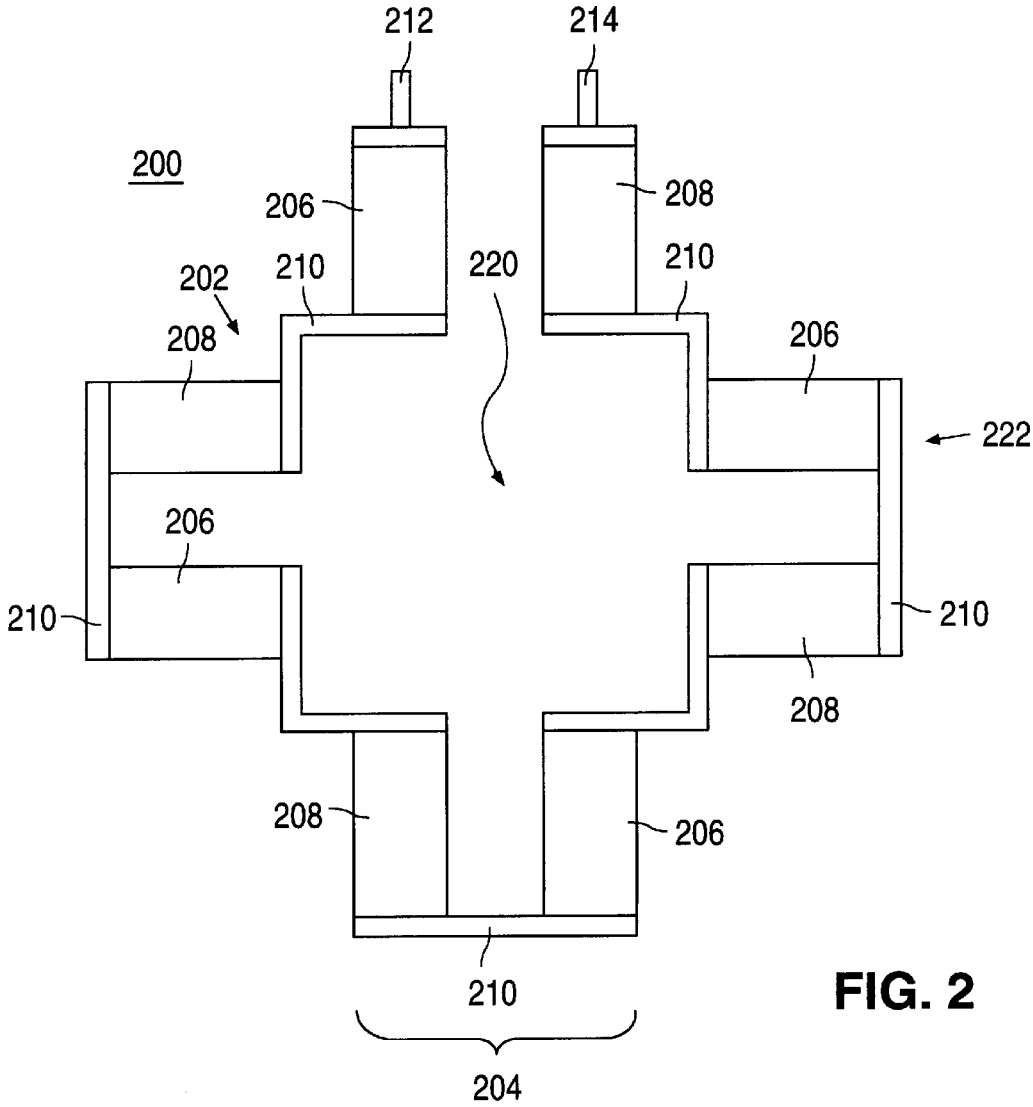
FIG. 2 shows a temperature control structure that includes a square array of Peltier temperature control cells.

Application of a voltage difference to an array of Peltier cells can result in precise temperature control over specific regions of an IC. FIG. 2 shows a temperature control structure that includes an array of Peltier cells.

Temperature control structure 200 comprises square array 202 of Peltier cells 204. Peltier cells 204 comprise alternating N- and P-type silicon regions 206 and 208, respectively, connected by an electrically conducting bridge structures 210. Array 202 is connected to a voltage supply by way of contacts 212 and 214.

Due to the Peltier Effect, application of a potential difference across contacts 212 and 214 of array 202 causes a temperature change at center region 220 relative to peripheral region 222.

Any semiconducting devices present at the center region 220 of will operate in a thermal environment that is different than the thermal environment present along periphery 222. Varying the voltage drop applied across array 202 will change the thermal environment of center region 220.

The Peltier temperature control structure just described can be utilized to maintain specific IC regions at a constant temperature in the face of changes in ambient temperature. The Peltier temperature control structure can thus form the temperature control element of a larger temperature regulator circuit, with the IC components performing both temperature-sensing and temperature-controlling functions.

Figure 3:
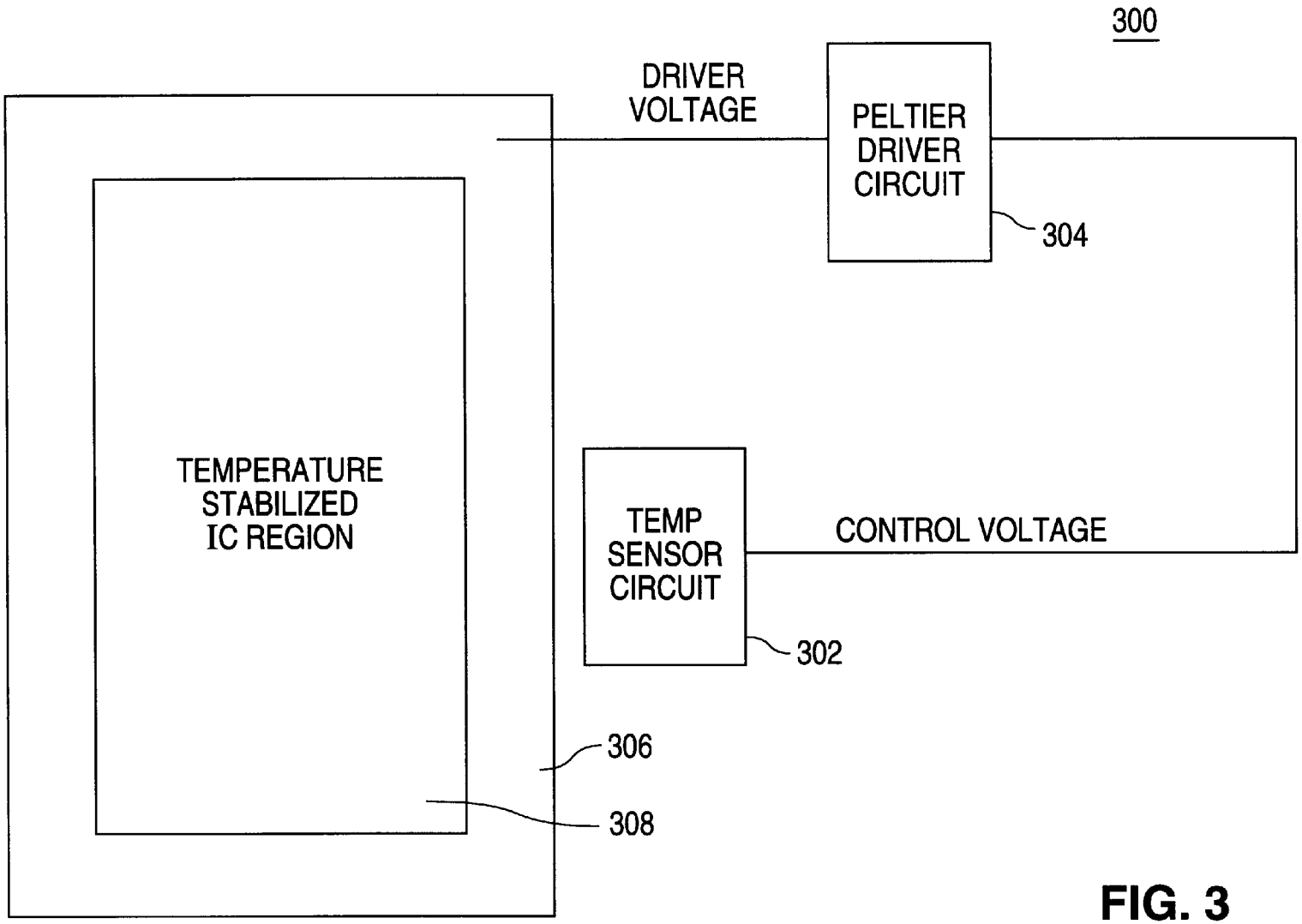
FIG. 3 shows a block diagram of a temperature regulator circuit in accordance with the present invention for controlling the thermal environment of a specific IC region.

FIG. 3 shows a functional block diagram of a temperature regulator circuit in accordance with the present invention. Temperature regulator circuit 300 includes a temperature sensor circuit 302, a driver circuit 304, and a temperature control structure 306. Temperature sensor circuit 302 produces a control voltage in response to changes detected in ambient temperature. Driver circuit 304 receives this control voltage and then provides a driver voltage to the temperature control structure 306. The driver voltage is of a polarity and magnitude sufficient to counteract the effect of changes in ambient temperature upon the local temperature of IC region 308 proximate to temperature control structure 306.

Elements 302, 304, and 306 of temperature regulator circuit 300 are readily available in the form of standard integrated circuit components. For instance, the well-known temperature dependence of the base-emitter voltage ($V_{BE}$) of a bipolar transistor can be utilized to generate a control voltage reflecting changes in ambient temperature. Moreover, conventional bipolar power transistor designs can be used to provide a driver voltage for the temperature control structure.

Figure 4:
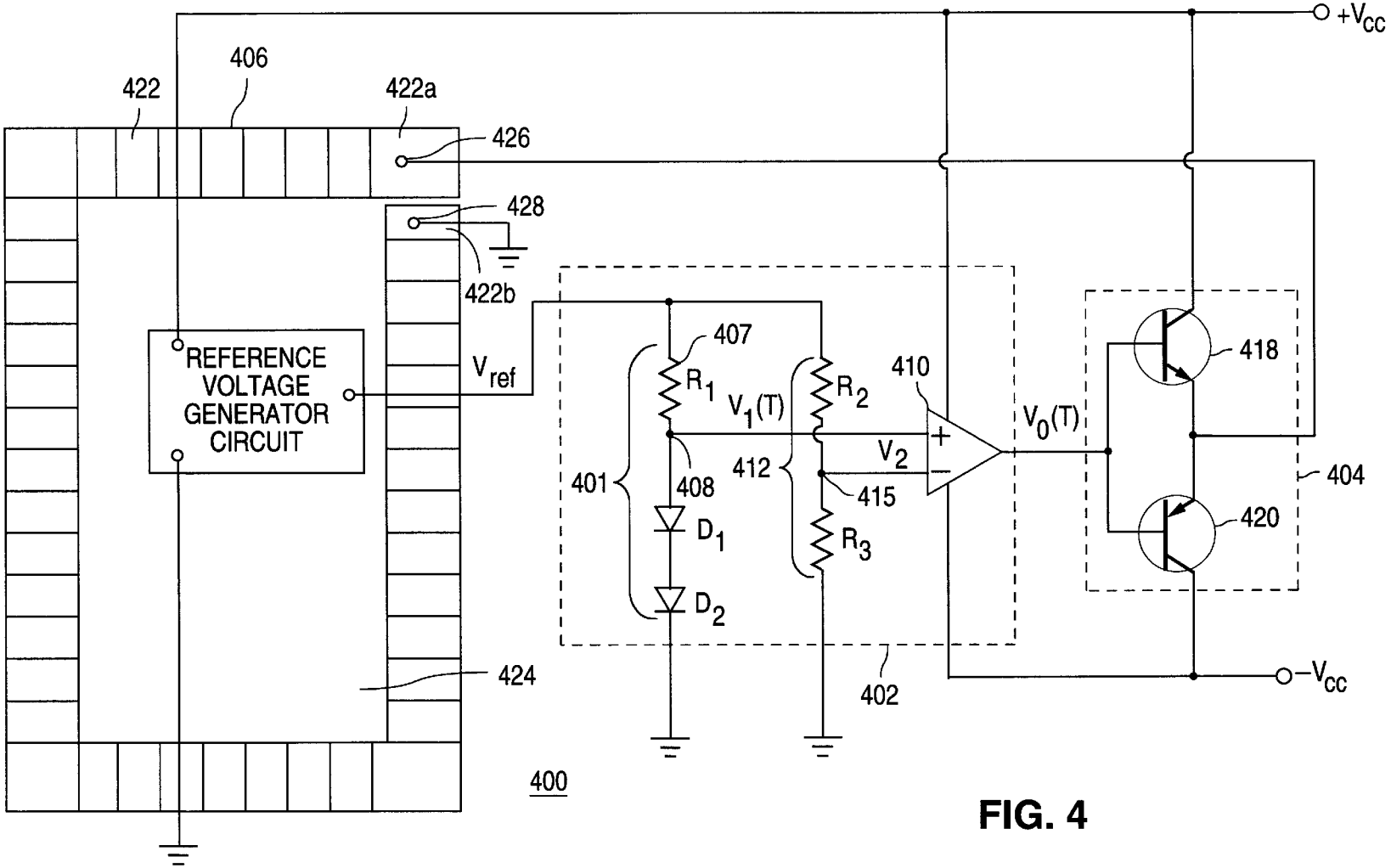
FIG. 4 shows a circuit schematic of one embodiment of a temperature regulator circuit in accordance with the present invention.

FIG. 4 thus shows one a circuit schematic of embodiment of a temperature regulator circuit in accordance with the present invention. As described above in conjunction with FIG. 3, temperature regulator circuit 400 includes temperature sensor circuit 402, driver circuit 404, and temperature control structure 406.

Temperature sensor circuit 402 comprises a temperature detecting circuit 401 that includes a first diode $D_1$ and a second diode $D_2$ connected in series between a first resistor $R_1$ linked to voltage reference generator circuit 403, and a ground. The temperature detecting circuit 401 receives the reference voltage $V_{ref}$ from voltage reference generator 403, producing a temperature-dependent detection voltage $V_1(T)$ from output node 408 positioned between $R_1$ and first diode $D_1$.

The temperature-dependent voltage drop $V_1(T)$ provided by diodes $D_1$ and $D_2$ provides excellent temperature sensing characteristics, as $V_1(T)$ varies linearly with temperature T, where:

$$V_1(T)=V_1(T_0)+\gamma_D(T-T_0).$$

In the above equation, $\gamma_D$ is the temperature coefficient of the diode pair. For base-emitter diodes, $\gamma_D$ is typically about −3 mV/° C.

$V_1(T_0)$ in the above equation is the nominal voltage drop across diodes $D_1$ and $D_2$ at a reference temperature ($T_0$). $T_0$ can be taken as room temperature (+25° C.). In most applications however, a "cooling" temperature $T_c$ below room temperature (such as +10° C.) is chosen so that some control voltage is generated at room temperature.

In order to provide a reliable temperature reference voltage $V_1(T_0)$, temperature sensor circuit 402 also comprises a temperature reference circuit 412 including a second resistor $R_2$ and a third resistor $R_3$ connected in series between reference voltage generator circuit 403 and circuit ground. Temperature reference circuit 412 receives the reference voltage $V_{ref}$ from voltage reference generator 403, and generates a temperature reference voltage $V_2$ at an output node 415 positioned between third resistor $R_3$ and second resistor $R_2$.

Temperature sensor circuit 402 further comprises a differential amplifier 410. Differential amplifier 410 receives detection voltage $V_1$ and temperature reference voltage $V_2$. From these inputs, differential amplifier 410 generates temperature-sensitive control voltage $V_0(T)$ reflecting the difference between $V_1$ and $V_2$, where:

$$V_0(T) = V_1 - V_2 = V_{BE}(T) - V_{ref}\frac{R_3}{R_3 + R_2}$$

Differential amplifier 410 then communicates control voltage $V_0(T)$ to driver circuit 404.

Driver circuit 404 comprises complementary NPN and PNP bipolar transistors 418 and 420, respectively. NPN transistor 418 includes a collector coupled to high voltage rail $+V_{cc}$, a base receiving the control voltage from differential amplifier 410, and an emitter. PNP transistor 420 includes an emitter coupled to the emitter of NPN transistor 418, a base receiving the control voltage from differential amplifier 410, and a collector coupled to low voltage rail $-V_{cc}$. This configuration permits driver circuit 404 to receive the control voltage from the temperature sensor circuit 408 and then to communicate a corresponding positive or negative driver voltage to the temperature control structure 406.

Peltier temperature control structure 406 comprises an array of Peltier cells 422 formed in a square around a central region 424. Input node 426 at first Peltier cell 422*a* of temperature control structure 406 is connected to the linked emitters of bipolar transistors 418 and 420 of driver circuit 404. Second node 428*a* at final Peltier cell 422 of temperature control structure 406 is connected to ground.

In the embodiment shown in FIG. 4, Peltier cells 422 surround integrated circuit region 424, enabling temperature control structure 406 to exert maximum control over the thermal environment of region 424. The driver voltage communicated to input node 426 from driver circuit 404 is sufficient to activate temperature control structure 406 and counteract the effect of changes in ambient temperature upon center region 424.

One very important application of temperature regulator circuits in accordance with the present invention is design of voltage references. There are two primary forms of reference voltage generators: circuits utilizing Zener breakdown characteristics, and circuits utilizing band gap characteristics.

The Zener diode is a specially designed PN junction useful to provide a reference voltage when operated in the reverse bias breakdown region. The Zener diode exhibits breakdown under a predetermined applied potential of typically less than about 6 V.

Figure 5A:
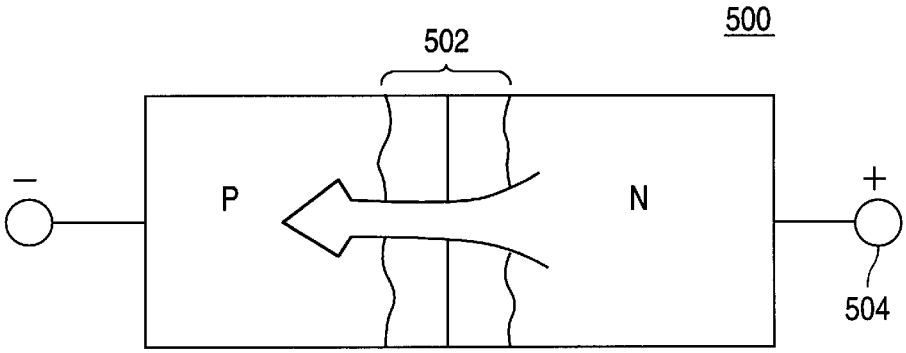
FIG. 5A (PRIOR ART)
FIG. 5A shows a schematic representation of the operation of a Zener diode.

FIG. 5A shows a schematic representation of operation of a Zener diode 500, with breakdown occurring under reverse biasing conditions. Specifically, breakdown occurs due to ionization of the atoms present in the depletion region 502 triggered by the intensity of the applied electric field. This ionization causes the electrons of large numbers of atoms in depletion region 502 to break away and flow to positive pole 504. The breakdown voltage of a semiconducting device is determined by the concentration of conductivity-altering dopant present on the less-concentrated side of the PN junction. Thus, in the case of a monolithic NPN bipolar transistor, the dominant influence upon the emitter-base breakdown is the dopant concentration of the base.

Figure 5B:
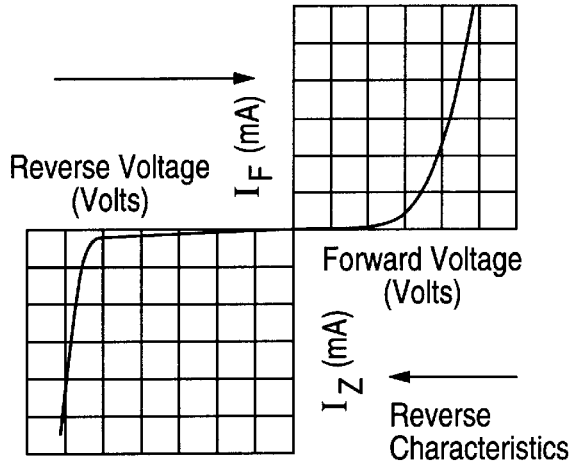
FIG. 5B (PRIOR ART)
FIG. 5B plots voltage versus current illustrating the operational characteristics of a Zener diode.

FIG. 5B plots voltage versus current for a typical Zener diode. As shown in FIG. 5B, under forward biasing conditions the voltage curve of the diode is similar to that of a normal high voltage rectifier. However, under reverse bias conditions, the initial leakage current is very low. However when the breakdown point is reached, the reverse current increases very rapidly for only a slight increase in voltage. Thus, under a negative applied voltage, the voltage curve of FIG. 5B shows a pronounced sharp bend, or "knee."

By biasing the Zener diode permanently in the reverse breakdown region, this diode can be used as a stable voltage reference because the voltage across the device will remain essentially constant over large variations in the amount of current flowing through the device.

The relationship between ambient temperature and the magnitude of applied voltage giving rise to breakdown exhibits positive or temperature coefficients (e.g., about ±3 mV/° C.) depending upon whether avalanche or Zener breakdown is occurring, respectively. The temperature coefficient of a forward-biased diode is negative. Therefore, forward-biased diodes and reverse-biased Zener diodes (in avalanche breakdown) have conventionally been connected in series to create a reference voltage generator circuit exhibiting reduced temperature sensitivity.

While Zener diodes can be used to generate voltages, they are less common than reference voltage generator circuit utilizing band gap properties. This is because Zener diodes are inherently noisy, and thus exhibit poor performance in low noise or low voltage applications.

Figure 6:
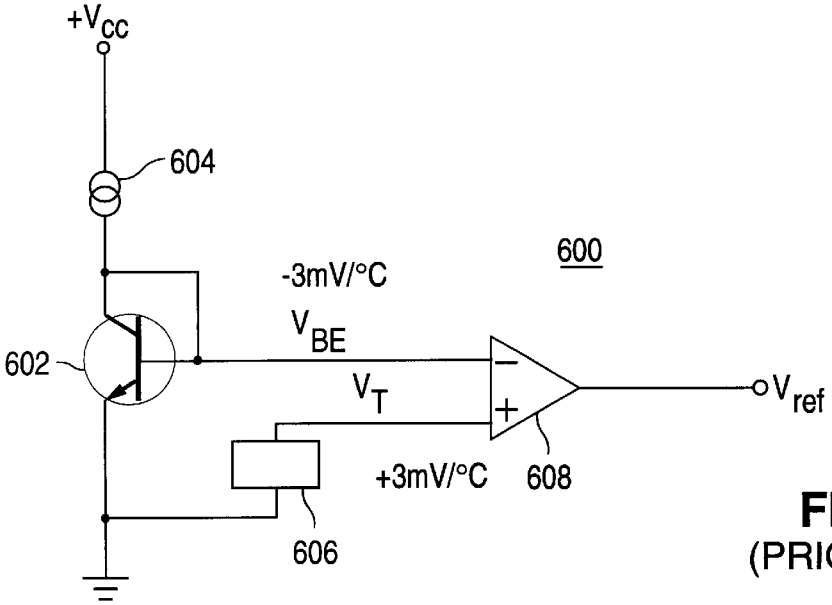
FIG. 6 (PRIOR ART)
FIG. 6 shows a circuit schematic of a conventional band-gap voltage reference circuit.

In band-gap voltage reference generator circuits, an output reference voltage is obtained by adding a correction voltage to the base-emitter voltage of a bipolar transistor to minimize the temperature dependence of the base-emitter voltage FIG. 6 shows a schematic of a simple reference voltage generator circuit utilizing band-gap principles.

Conventional band gap reference voltage generator circuit 600 includes NPN bipolar transistor 602 having its collector and base terminals shorted and connected to constant current source 604. The emitter of transistor 602 is grounded.

The temperature coefficient of the voltage $V_{BE}$ of the base-emitter diode is about −3 mV/° C. The temperature coefficient of $V_{BE}$ is thus less than 3 ppm/° C.

The precision of any voltage reference circuit must be maintained over a long period of time and under various external conditions. To achieve this stability in band-gap voltage reference generators, it has conventionally been necessary to provide a positive correction voltage $V_T$ to compensate for changes in $V_{BE}$ due to variations in the ambient temperature of reference transistor 602. Therefore, conventional band gap reference voltage circuit 600 includes a temperature compensation element 606.

Historically, the only voltage known to possess the requisite thermal characteristics was the difference between base-emitter voltages of a matched pair of bipolar transistors operated at unequal emitter-current densities. Temperature compensation element 606 thus includes such a matched pair of bipolar transistors operated under these conditions. When the ratio of the current densities is maintained constant, this thermal voltage $V_T$ is proportional to the absolute temperature.

Specifically, the negative temperature coefficient of $V_{BE}$ is compensated for by a positive coefficient $$V_T = kT/q$$

which is scaled by a K-factor (not to be confused with Boltzman's constant "k").

When $V_{BE}$ of bipolar transistor 602 and $V_T$ of temperature compensation element 606 are fed into differential amplifier 608, the resulting output reference voltage $V_{ref}$ is given by:

$$V_{ref} = V_{BE} + KV_T.$$

Since $V_{BE}$ and $KV_T$ exhibit opposite-polarity temperature coefficients, it is theoretically possible to design a $V_{ref}$ of a conventional voltage reference circuit that is temperature insensitive. In this manner, the negative temperature coefficient of $V_{BE}$ (about −3 mV/° C.) may be compensated for by the positive temperature coefficient of the thermal voltage $V_T$ (about +3300 ppm/° C.).

In practice it has proven difficult to design a voltage reference circuit that satisfactorily compensates for changes in voltage output due to a rise or fall of ambient temperature.

This problem is solved by the present invention. Specifically, the output of a voltage reference circuit is stabilized with respect to ambient temperature by utilizing Peltier heating and cooling as previously discussed.

For example, the $V_{BE}$ of a bipolar transistor can be precisely controlled by forming a temperature regulator circuit in the IC, and then positioning the voltage reference generator proximate to the temperature control structure. In other words, the components of the voltage reference generator are placed in a miniature "refrigerator" (the Peltier temperature control structure) formed on the chip. The "thermostat" for this micro-refrigerator is the temperature sensor circuit; the power supply for this micro-refrigerator is the driver circuit.

Figure 7:
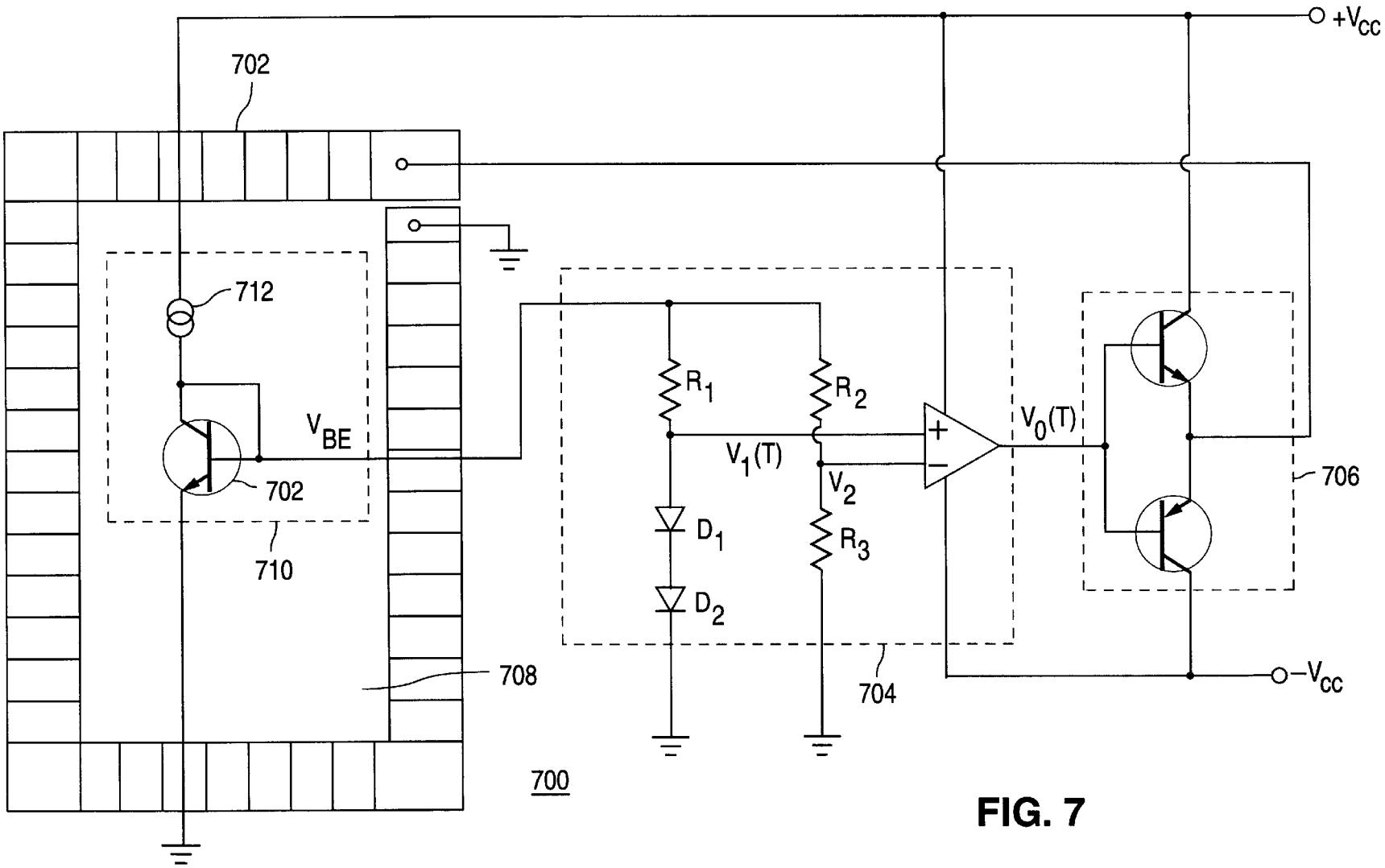
FIG. 7 shows a circuit schematic of one embodiment of a voltage reference circuit in accordance with the present invention.

FIG. 7 shows a voltage reference circuit utilizing band gap properties in accordance with a first embodiment of the present invention. Voltage reference circuit 700 includes temperature control structure 702, temperature sensor circuit 704, and driver circuit 706.

Reference voltage generator circuit 710 is located at central region 708 surrounded by temperature control structure 702. In the embodiment of FIG. 7, voltage reference generator 710 comprises NPN bipolar transistor 702 having an emitter and shorted base and collector terminals connected to constant current source 712. Constant current source 712 is powered by high voltage rail $+V_{cc}$. The emitter of bipolar transistor 702 is grounded. The base-emitter diode of bipolar transistor 702 is thus forward biased.

The base-emitter voltage ($V_{BE}$) is communicated as a reference voltage to temperature sensor circuit 704 and to other structures of the integrated circuit. Operation of the remainder of voltage reference circuit 700 is as explained in detail in conjunction with FIG. 4.

If the thermal environment of the voltage reference can be stabilized to ±1.0° C. over an ambient temperature change from −55° C. to +125° C., an inherently stable voltage reference circuit will be created. Such a voltage reference circuit would exhibit a drift of ±50 ppm/° C. change of chip temperature, and would thus appear stable to a ±0.1 ppm/° C. change in ambient temperature. This indicates that the temperature coefficient is reduced by over a factor of 1000. In this manner, voltage reference circuits with temperature drifts of ≦0.1 ppm/° C. may be incorporated directly on an IC with little additional cost.

In order to minimize the effect of thermal gradients on the chip, the voltage reference circuit to be stabilized should be laid out symmetrically within the temperature control structure with respect to other parasitic elements. The threshold level of the temperature control unit is then established such that the micro-refrigerator is operative to maintain the thermal environment of the voltage reference element at a relatively constant level over the entire temperature range of interest.

Upon activation, the circuit will not instantaneously produce a constant reference voltage. Rather, some small time delay will be required for the temperature control structure to establish an equilibrium temperature.

The opportunity to match electronic components provides the IC designer with a diverse set of design techniques. Imaginative application of Peltier temperature control should facilitate fabrication of monolithic analog voltage reference circuits offering superior performance characteristics.

Although the invention has been described in connection with one specific preferred embodiment, it should be understood that the invention as claimed should not be unduly limited to such specific embodiments. Various other modifications and alterations in the structure and method of operation of this invention will be apparent to those skilled in the art without departing from the scope of the present invention.

For example, the temperature sensor circuit in accordance with the present invention depicted in FIGS. 4 and 7 utilizes a pair of forward biased diodes to detect changes in ambient temperature and to generate a signal reflecting this temperature change. However, the temperature regulator and voltage reference circuits in accordance with the present invention are not limited to this embodiment. Other temperature sensing structures such as thermistors and thermocouples could also be employed and the resulting circuit would fall within the scope of the present invention.

Moreover, while the embodiment of the voltage reference circuit in accordance with the present invention depicted in FIGS. 4 and 7 has been illustrated with respect to a temperature control structure in the form of a square-shaped array of Peltier cells, the invention is not limited to a this specific structure. As described in detail in copending application Ser. No. 09/216,282, the temperature control structure could possess a variety of shapes and still remain within the scope of the present invention.

Furthermore, while the embodiment of the voltage reference circuit depicted in FIG. 7 in accordance with the present invention has been illustrated with respect to minimizing the temperature sensitivity of a reference voltage generator circuit in the form of an NPN bipolar transistor, the present invention should not be limited to this embodiment. Voltage reference generators in the form of PNP bipolar transistors, Zener diodes, or other temperature-dependent voltage reference generators could also be positioned proximate to a Peltier temperature control structure and remain within the scope of the present invention.

Therefore, it is intended that the following claims define the scope of the present invention, and that the methods and structures within the scope of these claims and their equivalents be covered hereby.

What is claimed is:

1. An apparatus including a temperature regulator circuit for maintaining a region of an integrated circuit at a substantially constant temperature, comprising:

a temperature sensor circuit formed on the integrated circuit, the temperature sensor circuit generating a control voltage in response to a change in ambient temperature;

a driver circuit formed on the integrated circuit, the driver circuit receiving the control voltage and generating a driver voltage; and a temperature control structure formed as part of the integrated circuit, the temperature control structure receiving the driver voltage and in response causing one of a plurality of Peltier effects which include heating and cooling of the integrated circuit region.

2. An apparatus including a voltage reference circuit for an integrated circuit, comprising:

a temperature regulator circuit for maintaining a region of the integrated circuit at a substantially constant temperature, the temperature regulator circuit including, a temperature sensor circuit formed on the integrated circuit, the temperature sensor circuit receiving a reference voltage and generating a control voltage in response to a change in ambient temperature, a driver circuit formed on the integrated circuit, the driver circuit receiving the control voltage and generating a driver voltage, and a temperature control structure formed proximate to integrated circuit region, the temperature control structure receiving the driver voltage and in response causing one of Peltier heating and cooling of the integrated circuit region; and a reference voltage generator circuit positioned in the integrated circuit region and generating the reference voltage.

3. A method of providing a temperature-insensitive reference voltage for an integrated circuit, the method comprising the steps of:

providing a reference voltage generator circuit on a region of an integrated circuit;

forming a temperature control structure on the integrated circuit proximate to the integrated circuit region;

detecting a change in an ambient temperature; and applying a voltage to the temperature control structure to cause one of a plurality of Peltier effects which include heating and cooling wherein the integrated circuit region is maintained at a substantially constant temperature.

4. An apparatus including a temperature regulator circuit for maintaining a region of an integrated circuit at a substantially constant temperature, the apparatus comprising:

a temperature sensor circuit formed on the integrated circuit, the temperature sensor circuit generating a control voltage in response to a change in ambient temperature, the temperature sensor circuit comprising, a temperature detecting circuit including at least one diode connected between a voltage source and a ground, the temperature detecting circuit producing a detection voltage at a first node positioned between the voltage source and the at least one diode, a temperature reference circuit including a first resistor and a second resistor connected in series between the voltage source and the ground, the temperature reference circuit producing a temperature reference voltage at a second node positioned between the first resistor and the second resistor, and a differential amplifier receiving the detection voltage and the temperature reference voltage and generating a control voltage reflecting a difference between the detection voltage and the temperature reference voltage;

a driver circuit formed on the integrated circuit, the driver circuit receiving the control voltage and generating a driver voltage; and a temperature control structure formed on the integrated circuit and proximate to a region of the integrated circuit, the temperature control structure receiving the driver voltage and in response causing one of a plurality of Peltier effects which include heating and cooling of the integrated circuit region.

5. An apparatus including a temperature regulator circuit for maintaining a region of an integrated circuit at a substantially constant temperature, the apparatus comprising:

a temperature sensor circuit formed on the integrated circuit, the temperature sensor circuit generating a control voltage in response to a change in ambient temperature;

a driver circuit formed on the integrated circuit and receiving the control voltage and to generate a driver voltage, the driver circuit comprising, an NPN transistor having a collector coupled to a high voltage rail, a base receiving the control voltage, and an emitter, and a PNP transistor having an emitter coupled to the emitter of the NPN transistor, a base receiving the control voltage, and a collector coupled to a low voltage rail; and a temperature control structure formed on the integrated circuit and proximate to a region of the integrated circuit, the temperature control structure receiving the driver voltage and in response causing one of a plurality of Peltier effects which include heating and cooling of the integrated circuit region.

6. An apparatus including a temperature regulator circuit for maintaining a region of an integrated circuit at a substantially constant temperature, the apparatus comprising:

a temperature sensor circuit formed on the integrated circuit, the temperature sensor circuit generating a control voltage in response to a change in ambient temperature;

a driver circuit formed on the integrated circuit, the driver circuit receiving the control voltage and generating a driver voltage; and a temperature control structure formed on the integrated circuit and proximate to a region of the integrated circuit, the temperature control structure receiving the driver voltage and in response causing one of a plurality of Peltier effects which include heating and cooling of the integrated circuit region, the temperature control structure comprising, a doped portion of the integrated circuit containing conductivity-altering dopant and having a first end and a second end, a first metal contact connected to the first end and in electrical communication with the driver circuit, and a second metal contact connected to the second end and in electrical communication with the ground, wherein application of the driver voltage to the first metal contact causes a temperature change a temperature of the first contact relative to the second contact.

7. The apparatus according to claim 6 wherein the doped portion of the integrated circuit surrounds the integrated circuit region.

8. An apparatus including a voltage reference circuit for an integrated circuit, the apparatus comprising:

a temperature regulator circuit for maintaining a region of the integrated circuit at a substantially constant temperature, the temperature regulator circuit including, a temperature sensor circuit formed on the integrated circuit, the temperature sensor circuit receiving a reference voltage and generating a control voltage in response to a change in ambient temperature, the temperature sensor circuit comprising, a temperature detecting circuit including at least one diode connected between the reference voltage generator circuit and a ground, the temperature detector circuit receiving the reference voltage and producing a detection voltage at a first node positioned between the constant voltage source and the at least one diode, a temperature reference circuit including a first resistor and a second resistor connected in series between the reference voltage generator circuit and the ground, the temperature reference circuit receiving the reference voltage and producing a temperature reference voltage at a second node positioned between the first resistor and the second resistor, and a differential amplifier receiving the detection voltage and the temperature reference voltage and generating a control voltage reflecting a difference between the detection voltage and the temperature reference voltage, a driver circuit formed on the integrated circuit, the driver circuit receiving the control voltage and generating a driver voltage, and a temperature control structure formed proximate to integrated circuit region, the temperature control structure receiving the driver voltage and in response causing one of Peltier heating and cooling of the integrated circuit region; and a reference voltage generator circuit positioned in the integrated circuit region and generating the reference voltage.

9. An apparatus including a voltage reference circuit for an integrated circuit, the apparatus comprising:

a temperature regulator circuit for maintaining a region of the integrated circuit at a substantially constant temperature, the temperature regulator circuit including, a temperature sensor circuit formed on the integrated circuit, the temperature sensor circuit receiving a reference voltage and generating a control voltage in response to a change in ambient temperature, a driver circuit formed on the integrated circuit, the driver circuit receiving the control voltage and generating a driver voltage, the driver circuit comprising, an NPN transistor having a collector coupled to a high voltage rail, a base receiving the control voltage, and an emitter, and a PNP transistor having an emitter coupled to the emitter of the NPN transistor, a base receiving the control voltage, and a collector coupled to a low voltage rail, a temperature control structure formed proximate to integrated circuit region, the temperature control structure receiving the driver voltage and in response causing one of Peltier heating and cooling of the integrated circuit region; and a reference voltage generator circuit positioned in the integrated circuit region and generating the reference voltage.

10. An apparatus including a voltage reference circuit for an integrated circuit, the apparatus comprising:

a temperature regulator circuit for maintaining a region of the integrated circuit at a substantially constant temperature, the temperature regulator circuit including, a temperature sensor circuit formed on the integrated circuit, the temperature sensor circuit receiving a reference voltage and generating a control voltage in response to a change in ambient temperature, a driver circuit formed on the integrated circuit, the driver circuit receiving the control voltage and generating a driver voltage, and a temperature control structure formed proximate to integrated circuit region, the temperature control structure receiving the driver voltage and in response causing one of Peltier heating and cooling of the integrated circuit region, the temperature control structure comprising, a doped portion of the integrated circuit containing conductivity-altering dopant and having a first end and a second end, a first metal contact connected to the first end and in electrical communication with the driver circuit, and a second metal contact connected to the second end and in electrical communication with the ground, wherein application of the driver voltage to the first metal contact causes a temperature change at the first contact relative to the second contact; and a reference voltage generator circuit positioned in the integrated circuit region and generating the reference voltage.

11. The apparatus according to claim 10 wherein the doped portion of the integrated circuit surrounds the integrated circuit region.

12. An apparatus including a voltage reference circuit for an integrated circuit, the apparatus comprising:

a temperature regulator circuit for maintaining a region of the integrated circuit at a substantially constant temperature, the temperature regulator circuit including, a temperature sensor circuit formed on the integrated circuit, the temperature sensor circuit receiving a reference voltage and generating a control voltage in response to a change in ambient temperature, a driver circuit formed on the integrated circuit, the driver circuit receiving the control voltage and generating a driver voltage, and a temperature control structure formed proximate to integrated circuit region, the temperature control structure receiving the driver voltage and in response causing one of Peltier heating and cooling of the integrated circuit region; and a reference voltage generator circuit positioned in the integrated circuit region and generating the reference voltage, the reference voltage generator circuit comprising a diode connected between a high voltage rail and a ground, the diode generating the reference voltage.

13. The apparatus according to claim 12 wherein the diode comprises a reverse-biased Zener diode.

14. The apparatus according to claim 12 wherein the diode comprises a forward-biased base-emitter diode of a bipolar transistor.

15. A method of providing a temperature-insensitive reference voltage for an integrated circuit, the method comprising the steps of:

providing a reference voltage generator circuit on a region of an integrated circuit;

forming a temperature control structure proximate to the integrated circuit region by introducing conductivity-altering dopant into a portion of semiconducting material, and forming a first metal contact at a first end into the doped region and forming a second metal contact at a second end of the doped region;

detecting a change in an ambient temperature; and applying a voltage to the temperature control structure to cause one of a plurality of Peltier effects which include heating and cooling wherein the integrated circuit region is maintained at a substantially constant temperature.

16. The method according to claim 15 wherein the step of introducing conductivity-altering dopant into a portion of semiconducting material comprises introducing conductivity-altering dopant into a portion of semiconducting material surrounding the region of the integrated circuit.

17. A method of providing a temperature-insensitive reference voltage for an integrated circuit, the method comprising the steps of:

providing a reference voltage generator circuit on a region of an integrated circuit;

forming a temperature control structure proximate to the integrated circuit region;

detecting a change in an ambient temperature by forming at least one diode connected between a high voltage rail and a ground, the at least one diode producing an output voltage, and monitoring a change in the output voltage; and applying a voltage to the temperature control structure to cause one of a plurality of Peltier effects which include heating and cooling wherein the integrated circuit region is maintained at a substantially constant temperature.

18. A method of providing a temperature-insensitive reference voltage for an integrated circuit, the method comprising the steps of:

providing a reference voltage generator circuit on a region of an integrated circuit by forming a diode connected between a high voltage rail and a ground, the diode producing an output reference voltage;

forming a temperature control structure proximate to the integrated circuit region;

detecting a change in an ambient temperature; and applying a voltage to the temperature control structure to cause one of a plurality of Peltier effects which include heating and cooling wherein the integrated circuit region is maintained at a substantially constant temperature.

19. The method according to claim 18 wherein the step of forming a diode comprises forming a reverse-biased Zener diode.

20. The method according to claim 18 wherein the step of forming a diode comprises forming a forward-biased base-emitter diode of a bipolar transistor.

* * * * *